United States Patent [19]

Kreh et al.

[11] Patent Number: 4,935,205

[45] Date of Patent: Jun. 19, 1990

[54] CORROSION INHIBITION

[75] Inventors: Robert P. Kreh; Joseph T. Lundquist, both of Jessup; Wayne L. Henry, Gaithersburg, all of Md.

[73] Assignee: W. R. Grace & Co.-Conn., New York, N.Y.

[21] Appl. No.: 206,154

[22] Filed: Jun. 10, 1988

[51] Int. Cl.[5] ..... C23F 11/16

[52] U.S. Cl. ..... 422/15; 422/11; 422/12; 422/17; 252/8.555; 252/389.1; 252/390; 252/391; 252/392; 252/393; 252/404

[58] Field of Search ..... 422/11, 12, 15, 17; 252/8.555, 389.1, 390, 391, 392, 393, 404

[56] References Cited

U.S. PATENT DOCUMENTS

| | | | |
|---|---|---|---|
| 3,951,973 | 4/1976 | Nebzydoski | 252/47 |
| 4,026,664 | 5/1977 | Noack | 422/16 |
| 4,141,844 | 2/1979 | Yaffe | 252/47 |
| 4,141,845 | 2/1979 | Yaffe | 252/47 |
| 4,760,197 | 7/1988 | Tury et al. | 568/766 |

FOREIGN PATENT DOCUMENTS

| | | |
|---|---|---|
| 39130 | 11/1981 | European Pat. Off. . |
| 239288 | 9/1987 | European Pat. Off. . |
| 48-71740 | 9/1973 | Japan . |
| 51-93741 | 8/1976 | Japan . |
| 58-13338 | 2/1983 | Japan . |
| 61-78472 | 4/1986 | Japan . |
| 2060598 | 5/1981 | United Kingdom . |

*Primary Examiner*—Barry S. Richman
*Assistant Examiner*—Timothy M. McMahon
*Attorney, Agent, or Firm*—Howard J. Troffkin

[57] ABSTRACT

A method of inhibiting corrosion of iron or iron-based alloys which are in contact with an aqueous system by introducing and maintaining within the system at least one ortho dihydroxyaromatic compound having at least one electron withdrawing group pendant from the aromatic ring.

14 Claims, No Drawings

CORROSION INHIBITION

BACKGROUND OF THE INVENTION

The present invention is directed to an improved method of inhibiting corrosion of iron and iron-based alloys which are in contact with aqueous solutions. More specifically, the present method of inhibiting corrosion requires the use of adjacent paired or ortho dihydroxyaromatic compounds which contains at least one electron withdrawing group pendent from the aromatic ring. Besides being effective when used alone, it has been surprisingly found that a combination of the presently described dihydroxyaromatic compounds and certain conventional scale inhibiting agents dramatically enhance the effectiveness of corrosion inhibition.

Corrosion inhibition is necessary for protection of metal parts in equipment such as heat exchangers, pipes and engine jackets which are exposed to aqueous solution. Inhibitors are desired to prevent metal loss, pitting and tuberculation of such equipment.

Conventional corrosion inhibitors for iron and iron containing alloys each present certain drawbacks. For example, chromates are very effective but are very toxic, phosphates and organophosphonates can lead to scale deposition and are environmentally undesirable, zinc is not very effective at low levels (<1 ppm) or at high pH (above 7.5) due to the limited solubility of $Zn(OH)_2$ and molybdates are generally not cost-effective. Thus, there exists a need for a non-chromate, non-phosphorous-containing, cost-effective corrosion inhibitor for iron-based metals.

Catechol and certain derivatives have been used in aqueous systems in attempts to inhibit iron corrosion. Japanese No. 58/133382 discloses the use of catechol as a corrosion inhibitor in association with calcium chloride brine, while Japanese No. 51/93741 uses it in ground water of 90 ppm total hardness and Japanese No. 48/71740 suggests using mixtures of catechol and phosphonic acids. Proc. Conf. Nat. Assoc. Corros. Eng., 26th Conf. 536–40 teaches that increased corrosion inhibition can be achieved by the introduction of an electron-releasing alkyl substituent on catechol. The corrosion inhibiting phenomenon observed was attributed to the surface acitivity and limited solubility afforded by a large hydrophobic group.

In certain applications, metal surfaces have been coated to resist corrosion. Japanese No. 61/78472 discloses coating iron material with epoxy resins containing catechol and its derivatives to provide a solid barrier against corrosion. However, coating of iron surfaces is not a viable approach to corrosion inhibition where the surface exposed to the corrosive aqueous media is internal to the system, and thereby not readily coatable; where the system would require enlargement of the apparatus to permit proper flow rate after coating; and/or where the coating would detract from the heat transfer efficiency. The above problems present themselves in many applications such as heat exchangers, boilers, cooling towers, pipes and engine jackets. Thus, there is a need for corrosion inhibitors which will work while dissolved in aqueous solution. These additives must be soluble, stable and active under operating conditions and these properties must not be adversely affected by the water composition or other conditions associated with such systems. These conditions include the presence of oxygen in the aqueous system which accelerates corrosion, the high degree of hardness associated with excessive amounts of calcium, magnesium and carbonate ions, as well as elevated temperature and pH conditions of these systems.

SUMMARY OF THE INVENTION

The present invention is directed to a method of inhibiting corrosion of iron and iron-based metals which are in contact with aqueous systems. The present method requires the use of a water-soluble aromatic compound having adjacent-paired or ortho dihydroxy groups and, in addition, at least one electron withdrawing group or the use of the subject dihydroxy aromatic compounds in combination with certain known inhibitors.

DETAILED DESCRIPTION OF THE INVENTION

The present invention is directed to a method of inhibiting corrosion of iron and iron-based metals which are in contact with aqueous solutions. The present process is particularly useful in the application of heat exchangers, boilers, cooling water systems and the like where the aqueous medium has a high degree of hardness (mineral content), is at high temperatures (usually greater than 100° F.) and/or of high pH (pH of 7 or greater) and may contain aerated oxygen.

The compound required to be used in the present process will be described herein and in the appended claims as an aromatic compound having adjacent-paired dihydroxy groups or ortho dihydroxy groups as well as at least one electron withdrawing group directly attached to the aromatic moiety. The term "ortho" refers herein and in the appended claims to the positioning of two hydroxy groups on adjacent carbon atoms of a single benzylic ring. The benzylic ring can be part of a fused aromatic ring hydrocarbon compound as well as of a single aromatic ring. The term "adjacent-paired" refers herein and in the appended claims to the positioning of two hydroxy groups on a fused aromatic ring hydrocarbon in such stereo position to permit both hydroxy groups to act together and interact with an atom of iron (such as by chelation). Examples of adjacent-paired dihydroxy groups include the 4,5 and 1,8 pairs of naphthalene; the 4,10; 5,10; 1,9 and 8.9 of anthracene; and the 1,10 and 8,9 of phenanthrene and the like. The term "paired" shall be used herein and in the appended claims to generically include "ortho" and "adjacent paired" positioning of the dihydroxy groups.

It has now been unexpectedly found that paired dihydroxyaromatic compounds which also contain electron-withdrawing substituents are good corrosion inhibitors for iron-based metals when these compounds are dissolved in the aqueous solution in contact with the metal. This is in contrast to prior art which indicated that electron releasing alkyl and alkoxy substituents are preferred (Proc. Int. Congr. Met. Corros., 5th, 1972, 579–581 and Proc. Conf. Nat. Ass. Corros. Eng., 26th, 536–540). It has now been discovered that the presently described dihydroxyaromatic compound having at least one electron-withdrawing group substituted on the aromatic moiety provides a stable and soluble agent capable of imparting a high degree of corrosion inhibition. In addition, it has been unexpectedly observed that a combination of certain conventional agents and the present compound provides superior inhibiting properties.

The compounds required to be used according to the method of the present invention are aromatic compounds containing two hydroxyl groups which are positioned ortho or adjacent paired to one another and containing at least one electron withdrawing group. The term "aromatic" as used in this description and in the appended claims shall, unless specifically indicated otherwise, refers to benzylic compounds, such as benzene, naphthalene, anthracene and the like. The term "electron-withdrawing group" refers herein and in the appended claims to any group which has an electron-withdrawing inductive effect which is known to intensify a positive charge and destabilize a carbonium ion of the aromatic group. Such electron-withdrawing groups include $—SO_3H$, SOR, $SO_2R$, $—NO_2$, —F, —Cl, —Br, —CHO, $—CHCH_3$, —COR, $—CONH_2$, —CONHR, $CONR_2$, $—CO_2H$, $—PO_3H_2$ and the like (where R=an alkyl group). The preferred groups are sulfonyl, carboxyl and nitro groups. Examples of the subject compounds are 3,4-dihydroxybenzenesulfonic acid (catechol-4-sulfonic acid), 4-nitro-1,2-benzenediol, 3-4-dihydroxybenzoic acid, 6,7-dihydroxy-2-naphthalenesulfonic acid, 4,5-dihydroxynaphthalene-2,7-disulfonic acid, catechol-3,5-disulfonic acid, and the like and salts of said acids. The salts are preferably formed from alkali and alkaline earth metals.

The required compound can be represented by the formula:

$$Q-(Ar)-(OH)_2$$

wherein Ar represents an aromatic moiety, Q represents an electron withdrawing group substitute on the aromatic moiety and the hydroxyl groups are ortho or adjacent-paired positioned on the aromatic Ar group.

In addition to being effective corrosion inhibitors when used as the sole inhibiting agent in the aqueous medium, the subject inhibitor can be used in combination with known corrosion inhibiting agents to unexpectedly provide superior inhibiting properties. Examples of each of the classes of corrosion inhibiting agents found to achieve the unexpected superior properties are organophosphates including 1-hydroxyethylidene-1,1-diphosphonic acid, aminotrimethylene phosphonic acid, 2-phophonobutane-1,2,4-tricarboxylic acid, 1-phosphono-1-hydroxyacetic acid, hydroxymethylphosphonic acid and the like; phosphates such as sodium pyrophosphate, potassium pyrophosphate and the like; chromates such as sodium chromate, sodium dichromate, chromic acid and the like; molybdates such as sodium molybdate, molybdenum trioxide, molybdic acid and the like; zinc such as zinc sulfate, chloride and chromate salts and the like; and azoles such benzotriazole, tolyltriazole, mercaptobenzothiazole and the like.

The method of this invention for inhibiting corrosion of iron and iron-based metals which are in contact with aqueous systems comprises maintaining in the aqueous liquid from 0.1 to 50,000 parts per million ("ppm"), preferably 1 to 1000 ppm and most preferably 5 to 200 ppm of at least one of the subject paired dihydroxy aromatic compounds. The treatment composition employed for this invention can be added to the water by conventional bypass feeder using briquettes containing the treatment, by adding the compounds either separately or together as dry powder mixtures to the water, or it can be fed as an aqueous feed solution containing the treatment components.

The subject corrosion inhibiting agent or combination of agents can be readily dissolved in the aqueous medium. The medium may, in addition, contain other known agents for water treatment, such as chelants, scale inhibitors, pH regulating agents, dispersants, biocides and the like. Examples of chelants are N,N,N',N'-ethylenediamine tetraacetic acid and N,N'-bis(2-hydroxybenzyl) ethylenedinitrilo-N,N'-diacetic acid. Examples of pH regulating agents are acid (e.g., $H_2SO_4$), base (e.g., NaOH), and various buffers (e.g., phosphate or borate). Examples of scale inhibitors are organophosphonates and polyacrylates. Examples of dispersants include carboxylate and sulfonate containing polymers. Examples of biocides are chlorine- and bromine-containing materials and quaternary ammonium salts.

The compounds found useful in the process of this invention are relatively non-toxic and prevent corrosion of ferrous metals in contact with aqueous liquids. These compounds can be used for partial or complete substitution of chromate-based corrosion inhibitors previously used, where the toxicity of the chromate make its use undesirable. The subject paired dihydroxyaromatic compounds can also be used for partial or complete substitution of phosphate and/or organophosphonate inhibitors to minimize scaling and/or environmental detriments associated with the use of these phosphorous-based inhibitors. Likewise, these compounds can be used to replace all or part of the zinc based inhibitors used in some corrosion inhibitor formulations, yielding a more environmentally-acceptable formulation and minimizing zinc fouling at high pH. These substituted dihydroxyaromatic compounds provide a more economically viable additive over the use of molybdates.

The weight ratio of the present additive to a conventional known inhibitor of phosphate, organophosphate chromate, molybdate or zinc should be from about 100:1 to 1:100 and preferably from 50:1 to 1:50.

The use of the subject paired dihydroxy aromatic compounds which contain electron-withdrawing substituents (either alone or in combination with known corrosion inhibitors) in aqueous solutions has unexpectedly been found to prevent metal loss, pitting and tuberculation of iron-based alloys in contact with water.

The following examples are given for illustrative purposes only and are not meant to be a limitation on the present invention as defined by the claims. All parts and percentages are by weight unless otherwise indicated.

EXAMPLES 1–5

Test water was prepared to simulate that found in cooling tower systems. The water contained 99 parts per million (ppm) $CaSO_4$, 13 ppm $CaCl_2$, 55 ppm $MgSO_4$ and 176 ppm $NaHCO_3$. To separate aliquats of the test water was added the additive listed in Table I, and the solution was then adjusted to pH=8.5 with NaOH(aq). A clean, preweighed SAE 1010 mild steel specimen was suspended in 0.8 liters of test solution, which was stirred at 25° C. for 24 hours. The mild steel specimen was then cleaned, dried under vacuum at 60° C. and weighed. The corrosion rates, expressed in mils (thousandths of an inch) per year (mpy) were determined from this weight loss and are listed in Table I for each additive.

TABLE I

| Example | Additive (50 ppm) | Overall Corrosion Rate (mpy) | % Corrosion Inhibition |
|---|---|---|---|
| 1 | none | 42 | 0 |
| 2 | catechol (a) | 27 | 36 |
| 3 | catechol-4-sulfonic acid | 3 | 93 |
| 4 | catechol-4,5-disulfonic acid | 3 | 93 |
| 5 | chromotropic acid (b) | 1 | 98 |

(a) Precipitate present at the end
(b) 4,5-dihydroxynaphthalene-2,7-disulfonic acid

EXAMPLES 6-15

The procedure of examples 1-5 was repeated, but the solutions were heated at 54° C. during the run. The additives and resulting corrosion rates are listed in Table II. These results demonstrate the benefit of using substituted dihydroxy aromatics in combination with known corrosion inhibitors.

TABLE II

| Example (c) | Additives | ppm | Overall Corrosion Rate (mpy) | % Corrosion Inhibition |
|---|---|---|---|---|
| 6 | none | 0 | 154 | 0 |
| 7 | catechol-4-sulfonic acid | 30 | 75 | 60 |
| 8 | $ZnSO_4$ (a) | 1.5 | 182 | −18 |
| 9 | $ZnSO_4$ | 1.5 | 8 | 95 |
| | catechol-4-sulfonic acid | 30 | | |
| 10 | $Na_2MoO_4$ (a) | 9 | 222 | −44 |
| 11 | $Na_2MoO_4$ | 9 | | |
| | catechol-4-sulfonic acid | 30 | 34 | 78 |
| 12 | citric acid | 30 | 106 | 29 |
| 13 | citric acid | 15 | 63 | 59 |
| | catechol-4-sulfonic acid | 15 | | |
| 14 | HEDPA (b) | 15 | 61 | 60 |
| 15 | HEDPA | 15 | 17 | 89 |
| | catechol-4-sulfonic acid | 15 | | |
| 16 | HEDPA | 15 | 10 | 94 |
| | 4-nitrocatechol | 15 | | |
| 17 | HEDPA | 15 | 4 | 97 |
| | $ZnSO_4$ | 1.5 | | |
| | catechol-4-sulfonic acid | 15 | | |

(a) The amount of additive does not cause corrosion inhibition.
(b) HEDPA = hydroxyethylidene-1,1-diphosphonic acid.
(c) Examples 6, 8, 10, 12 and 14 are made for comparative purposes only.

What is claimed:

1. A method of inhibiting corrosion of iron based metal which is in contact with an aqueous solution comprising maintaining in the aqueous solution from 0.1 to 50,000 parts per million of at least one dihydroxylaromatic compound represented by the formula:

$$Q\text{-}(Ar)\text{-}(OH)_2$$

wherein Ar represents a single-ring aromatic moiety, Q represents at least one electron withdrawing group substituted on the Ar moiety selected from sulfonic acid, sulfonic acid salts and nitro group, and the hydroxyl (OH) groups are substituted on the Ar moiety in paired position with respect to each other.

2. The method of claim 1 wherein the aqueous system further contains at least one water treatment agent other than said dihydroxyaromatic compound.

3. The method of claim 1 wherein Q represents sulfonic acid or salts thereof.

4. The method of claim 3 wherein the aqueous system further contains at least one water treatment agent other than said dihydroxyaromatic compound.

5. The method of claim 1 wherein Q represents a nitro group.

6. The method of claim 5 wherein the aqueous system further contains at least one water treatment agent other than said dihydroxyaromatic compound.

7. The method of claim 1 wherein the dihydroxylaromatic compound is maintained at a concentration of from about 1 to 1000 ppm in the aqueous solution.

8. The method of claim 7 wherein Q represents a nitro group.

9. The method of claim 7 wherein Q represents sulfonic acid or salts thereof.

10. A method of inhibiting corrosion of iron based metal which is in contact with an aqueous system comprising maintaining in the aqueous system at least one corrosion inhibiting agent selected from phosphates, organophosphates, chromates, molybdates, azoles and zinc in combination with at least one dihydroxyaromatic compound represented by the formula $$Q\text{-}(Ar)\text{-}(OH_2)$$

wherein Ar represents a single-ring aromatic moiety, Q represents at least one electron withdrawing group substituted on the Ar moiety selected from sulfonic acid, sulfonic acid salts and nitro group, and the hydroxyl groups are substituted on the Ar moiety in paired position with respect to each other; said inhibiting agent and dihydroxyaromatic compound are present in a weight ratio of 100:1 to 1:100.

11. The method of claim 10 wherein the dihydroxyaromatic compound is present in from 0.1 to 50,000 ppm concentration in the aqueous system.

12. The method of claim 10 wherein the aqueous system further contains at least one water treatment agent other than said dihydroxyaromatic and said corrosion inhibiting agent.

13. The method of claim 10 wherein Q represents sulfonic acid or its metal salts.

14. The method of claim 10 wherein Q represents nitro group.

* * * * *